US007293894B2

(12) United States Patent
Shiau

(10) Patent No.: US 7,293,894 B2
(45) Date of Patent: Nov. 13, 2007

(54) FLASHLIGHT

(76) Inventor: Wen-Chin Shiau, No. 10, Alley 1, Lane 551, Sec. 1, Wan-Shou Rd., Kuei-Shan Hsiang, Tao-Yuan Hsien (TW)

( * ) Notice: Subject to any disclaimer, the term of this patent is extended or adjusted under 35 U.S.C. 154(b) by 107 days.

(21) Appl. No.: 11/342,082

(22) Filed: Jan. 27, 2006

(65) Prior Publication Data

US 2007/0103896 A1 May 10, 2007

(30) Foreign Application Priority Data

Nov. 8, 2005 (TW) ..... 94139100 A

(51) Int. Cl.
*F21L 4/04* (2006.01)

(52) U.S. Cl. ..... 362/205; 362/204

(58) Field of Classification Search ..... 362/202, 362/204–205

See application file for complete search history.

(56) References Cited

U.S. PATENT DOCUMENTS 3,924,116 A * 12/1975 Brindley ..... 362/158
4,843,526 A * 6/1989 Price, III ..... 362/187
4,951,183 A * 8/1990 Wang ..... 362/187
6,336,732 B1 * 1/2002 Shiau ..... 362/205

OTHER PUBLICATIONS

U.S. Appl. No. 11/377,061, filed Mar. 16, 2006, entitled "Flashlight" by Wen-Chin Shiau, 19 pages.

* cited by examiner

*Primary Examiner*—Ali Alavi
*Assistant Examiner*—Jason Moon Han
(74) *Attorney, Agent, or Firm*—Ladas & Parry LLP

(57) ABSTRACT

A switch device of a flashlight includes a tubular switch housing disposed in a barrel, abutting against a coupling ring mounted fixedly in the barrel, and having an outer circumferential surface formed with an engaging groove corresponding to a positioning groove in the inner surface of the barrel. The engaging groove has a depth that gradually increases toward an open end of the barrel. A switch unit is housed in the switch housing, and includes an operating member extending outwardly of the barrel through an opening in the switch housing and a through hole in the barrel. A wedge member engages the positioning groove in the barrel and the engaging groove in the switch housing, and has a thickness that gradually increases toward the open end of the barrel so as to prevent movement of the switch housing in the barrel.

4 Claims, 4 Drawing Sheets

FLASHLIGHT

CROSS-REFERENCE TO RELATED APPLICATION

This application claims priority of Taiwanese Application No. 094139100, filed on Nov. 8, 2005.

BACKGROUND OF THE INVENTION

1. Field of the Invention

The invention relates to a flashlight, more particularly to a flashlight having a switch device, which can be effectively positioned.

2. Description of the Related Art

Referring to FIG. 1, a conventional flashlight is shown to include a barrel 19 formed with a through hole 191, a coupling ring 13 mounted fixedly in the barrel 19, a lamp seat 12 mounted in the barrel 19, a lamp 18 mounted on the lamp seat 12, and a switch device.

With further reference to FIG. 2, the switch device includes a cylindrical switch housing 11, a switch module 16 and a water-resistant cover 17. The switch housing 11 has an open end 142 abutting against the coupling ring 13 and connected threadedly to the lamp seat 12. The switch housing 11 has an annular wall formed with an opening 141. The switch module 16 is housed in the switch housing 11, and is connected electrically to a conductive coil 121 of the lamp seat 12 by a wire and a conductive contact 145 on the switch housing 11 via a wire. The switch module 16 has an actuating button 161 extending outwardly of the barrel 19 through the opening 141 in the switch housing 11 and the through hole 191 in the barrel 19. The water-resistant cover 17 has a base portion 171 sandwiched between the switch housing 11 and the barrel 19, and a cap portion 172 connected to the base portion 171, covering the actuating button 161 of the switch module 16 and extending outwardly of the barrel 19 through the through hole 191.

It is noted that the switch housing 11 is composed of complementary first and second housing parts 14, 15 that have beveled interengaging surfaces 143, 151. However, when the beveled inter engaging surfaces 143, 151 of the first and second housing parts 14, 15 of the switch housing 11 cannot fully match each other as a result of manufacturing tolerance, movement of the switch housing 11 in the barrel 19 cannot be prevented.

SUMMARY OF THE INVENTION

Therefore, the object of the present invention is to provide a flashlight having a switch device, which can be effectively positioned.

According to the present invention, a flashlight comprises:

a barrel having an open end and an annular wall, the annular wall having an annular outer surface, and an annular inner surface formed with a positioning groove that extends from the open end in an axial direction of the barrel, the annular wall being formed with a through hole extending from the annular outer surface to the annular inner surface;

a coupling ring mounted fixedly on the annular inner surface of the annular wall of the barrel; and a switch device including a switch housing disposed in the barrel and having an open end that abuts against the coupling ring, the switch housing further having an outer circumferential surface formed with a receiving groove corresponding to the through hole in the annular wall of the barrel, and an engaging groove corresponding to the positioning groove in the inner surface of said annular wall of the barrel, the receiving groove being defined by a groove bottom wall and opposite lateral walls, the groove bottom wall being formed with an opening aligned with the through hole in the annular wall of the barrel, the engaging groove having a depth that gradually increases toward the open end of the barrel, a switch unit housed in the switch housing and including an operating member that extends outwardly of the barrel through the opening in the switch housing and the through hole in the annular wall of the barrel, and a wedge member engaging removably the positioning groove in the inner surface of the annular wall of the barrel and the engaging groove in the outer circumferential surface of the switch housing, and having a thickness that gradually increases toward the open end of the barrel, the wedge member being sandwiched between the barrel and the switch housing so as to prevent movement of the switch housing in the barrel.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
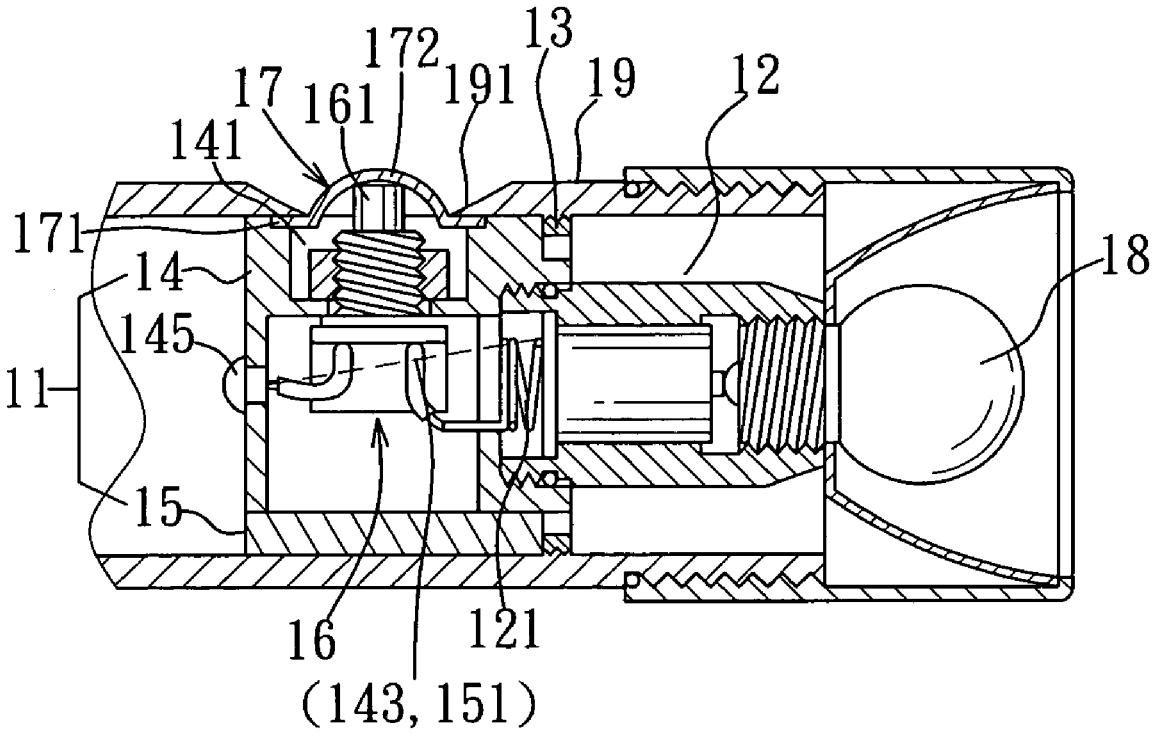
FIG. 1 PRIOR ART
FIG. 1 is a fragmentary schematic sectional view of a conventional flashlight.
Figure 2:
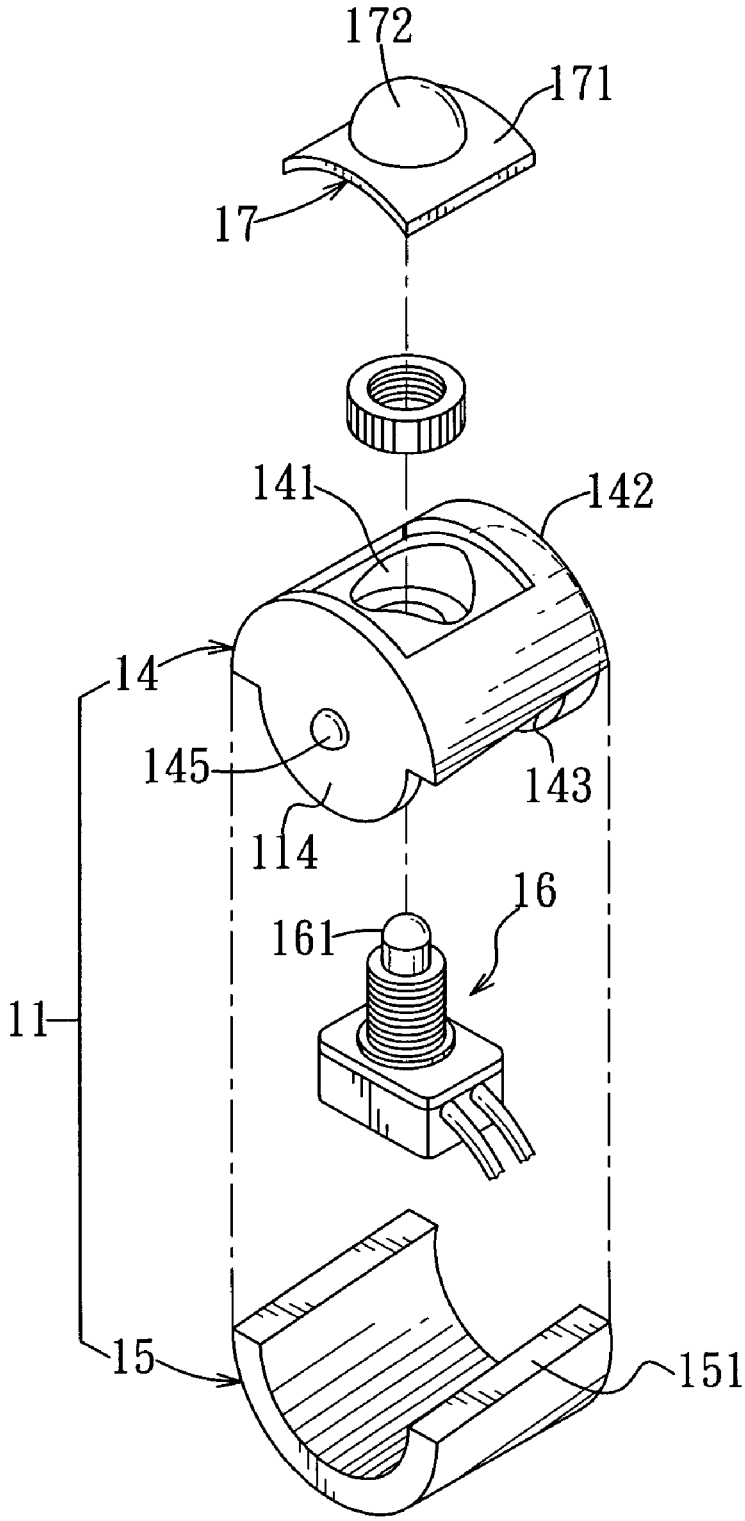
FIG. 2 PRIOR ART
FIG. 2 is an exploded perspective view of a switch device of the conventional flashlight.
Figure 3:
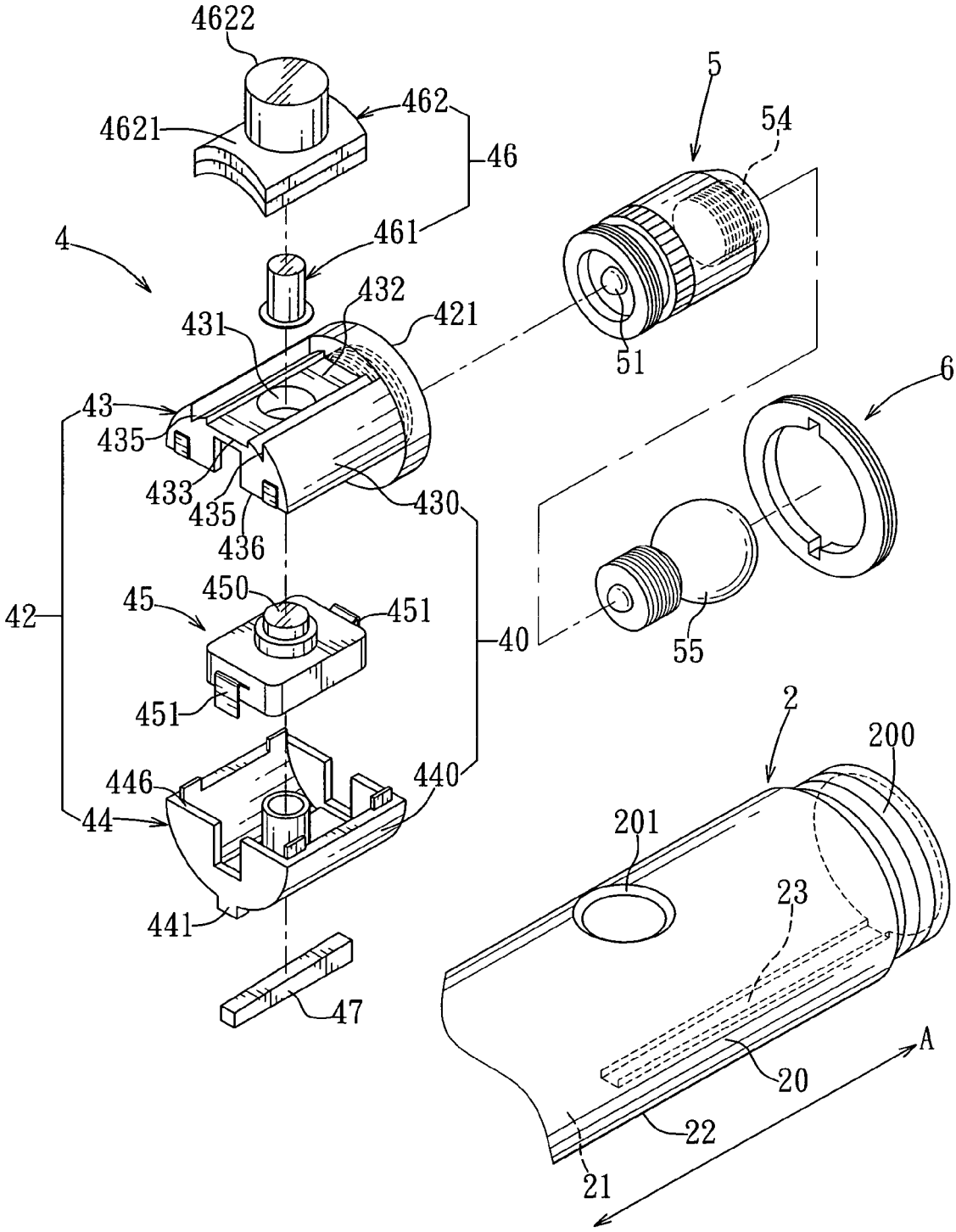
FIG. 3 is a fragmentary exploded perspective view showing the preferred embodiment of a flashlight according to the present invention.
Figure 4:
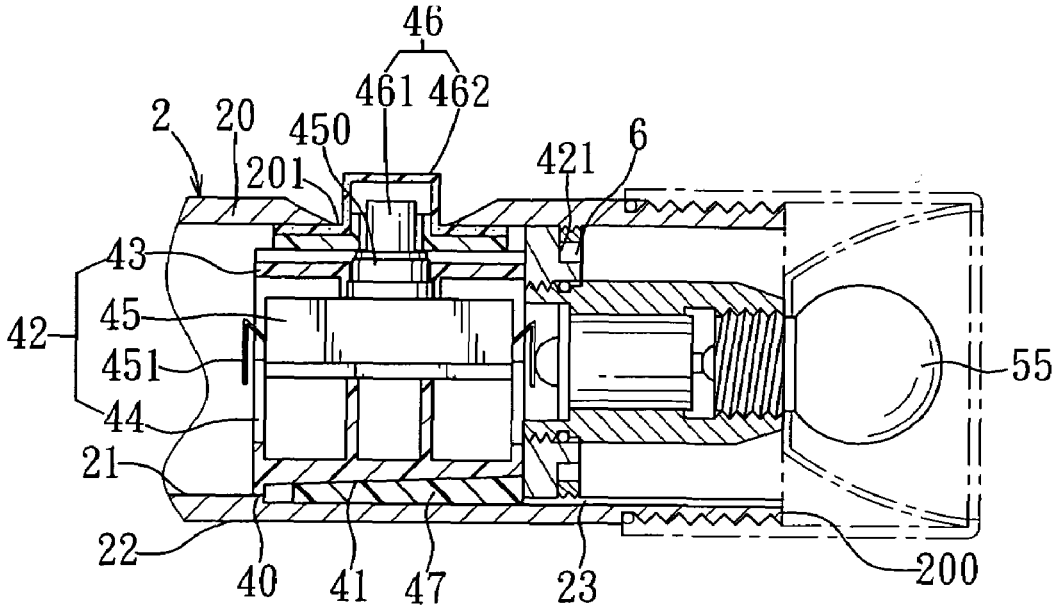
FIG. 4 is a fragmentary schematic sectional view of the preferred embodiment, taken along an axial direction of a barrel.
Figure 5:
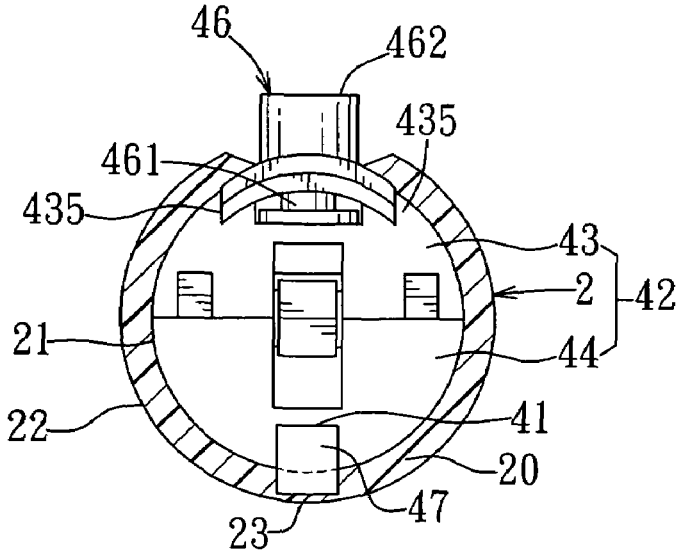
FIG. 5 is a partly sectional schematic view of the preferred embodiment, taken along a transverse direction of the barrel.

Referring to FIGS. 3 and 4, the preferred embodiment of a flashlight according to the present invention is shown to include a barrel 2, a coupling ring 6, and a switch device 4.

The barrel 2 has an open end 200 and an annular wall 20. The annular wall 20 has an annular outer surface 22, and an annular inner surface 21 formed with a positioning groove 23 that extends from the open end 200 in an axial direction (A) of the barrel 2. The annular wall 20 is formed with a through hole 201 extending from the annular outer surface 22 to the annular inner surface 21.

The coupling ring 6 is mounted fixedly on the annular inner surface 21 of the annular wall 20 of the barrel 2.

The switch device 4 includes a switch housing 42, a switch unit, and a wedge member 47. The switch housing 42 is disposed in the barrel 2, and has an open end 421 that abuts against the coupling ring 6. In this embodiment, a lamp seat 5 is mounted with a lamp 55, extends through the coupling ring 6, and is connected threadedly to the open end 421 of the switch housing 42. The switch housing 42 further has an outer circumferential surface 40. In this embodiment, the switch housing 42 is tubular, is made of metal, and is composed of complementary first and second housing parts 43, 44. Each of the first and second housing parts 43, 44 has an outer surface 430, 440. The outer surfaces 430, 440 of the first and second housing parts 43, 44 constitute the outer circumferential surface 40. The first and second housing parts 43, 44 have inter engaging surfaces 436, 446 extending along the axial direction (A). The outer surface 430 of the first housing part 43 is formed with a receiving groove 432 corresponding to the through hole 201 in the annular wall 20 of the barrel 2. The receiving groove 432 in the outer surface 430 of the first housing part 43 is defined by a groove bottom wall 433 and opposite lateral walls 435. The groove bottom wall 433 is formed with an opening 431 that is aligned with the through hole 201 in the annular wall 20 of the barrel 2. The second housing part 44 has an outwardly protruding projection 441 extending from the outer surface 440 and corresponding to the positioning groove 23 in the inner surface 21 of the annular wall 20 of the barrel 2. The projection 441 is formed with an engaging groove 41. The engaging groove 41 has a depth that gradually increases toward the open end 200 of the barrel 2, as shown in FIG. 4.

The switch unit is housed in the switch housing 42, and includes a switch module 45 and an operating member 46. In this embodiment, the switch module 45 has two conductive plates 451 extending outwardly and contacting electrically and respectively a conductive contact 51 of the lamp seat 5 and a battery (not shown), and a switching button 450. Since the switch module 45 is known in the art, a detailed description of the same is omitted herein for the sake of brevity. The operating member 46 extends outwardly of the barrel 2 through the opening 431 in the first housing part 43 of the switch housing 42 and the through hole 201 in the annular wall 20 of the barrel 2. In this embodiment, the operating member 46 includes an actuating rod 461 and a resilient water-resistant cover 462. The actuating rod 461 is disposed in the switch housing 42, and extends outwardly through the opening 431 in the first housing part 43 of the switch housing 42 and the through hole 201 in the annular wall 20 of the barrel 2, as shown in FIG. 4. The water-resistant cover 462 has a base portion 4621 disposed in the receiving groove 432 and sandwiched between the first housing part 43 of the switch housing 42 and the annular wall 20 of the barrel 2, and a cap portion 4622 connected to the base portion 4621, covering the actuating rod 461 and extending outwardly of the barrel 2 through the through hole 201 in the annular wall 20 of the barrel 2, as shown in FIG. 4.

The wedge member 47 engages movably the positioning groove 23 in the inner surface 21 of the annular wall 20 of the barrel 2 and the engaging groove 41 in the projection 441 of the second housing part 44 of the switch housing 42, and has a thickness in a direction perpendicular to the axial direction (A) that gradually increases toward the open end 200 of the barrel 2. The wedge member 47 is sandwiched between the barrel 2 and the switch housing 42 so as to prevent movement of the switch housing 42 in the barrel 2.

It is noted that, due to the presence of the wedge member 47, the switch housing 42 can be effectively positioned in the annular wall 20 of the barrel 2 even when the first and second housing parts 43, 44 do not fully match each other, thereby preventing movement of the switch housing 42 in the barrel 2. Furthermore, as a result of the positioning groove 23 in the annular wall 20 of the barrel 2, the switch housing 42 and the wedge member 47 can be guided to move into the barrel 2 during assembly.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A flashlight comprising:

a barrel having an open end and an annular wall, said annular wall having an annular outer surface, and an annular inner surface formed with a positioning groove that extends from said open end in an axial direction of said barrel, said annular wall being formed with a through hole extending from said annular outer surface to said annular inner surface;

a coupling ring mounted fixedly on said annular inner surface of said annular wall of said barrel; and a switch device including a switch housing disposed in said barrel and having an open end that abuts against said coupling ring, said switch housing further having an outer circumferential surface formed with a receiving groove corresponding to said through hole in said annular wall of said barrel, and an engaging groove corresponding to said positioning groove in said inner surface of said annular wall of said barrel, said receiving groove being defined by a groove bottom wall and opposite lateral walls, said groove bottom wall being formed with an opening aligned with said through hole in said annular wall of said barrel, said engaging groove having a depth that gradually increases toward said open end of said barrel, a switch unit housed in said switch housing and including an operating member that extends outwardly of said barrel through said opening in said switch housing and said through hole in said annular wall of said barrel, and a wedge member engaging movably said positioning groove in said inner surface of said annular wall of said barrel and said engaging groove in said outer circumferential surface of said switch housing, and having a thickness that gradually increases toward said open end of said barrel, said wedge member being sandwiched between said barrel and said switch housing so as to prevent movement of said switch housing in said barrel.

2. The flashlight as claimed in claim 1, wherein said switch housing is tubular, is made of metal, and is composed of complementary first and second housing parts, said first housing part being formed with said receiving groove, said second housing part having an outwardly protruding projection corresponding to said positioning groove in said inner surface of said annular wall of said barrel and formed with said engaging groove.

3. The flashlight as claimed in claim 2, wherein said first and second housing parts have interengaging surfaces extending along the axial direction of said barrel.

4. The flashlight as claimed in claim 1, wherein said operating member includes an actuating rod disposed in said switch housing and extending outwardly through said opening in said switch housing and said through hole in said annular wall of said barrel, and a resilient water-resistant cover that has a base portion disposed in said receiving groove and sandwiched between said switch housing and said annular wall of said barrel, and a cap portion connected to said base portion, covering said actuating rod and extending outwardly of said barrel through said through hole in said annular wall of said barrel.

* * * * *